US009504906B2

(12) United States Patent
Magyaros

(10) Patent No.: US 9,504,906 B2
(45) Date of Patent: Nov. 29, 2016

(54) GAME SET AND GAME

(76) Inventor: Barry Magyaros, Canton, MI (US)

( * ) Notice: Subject to any disclaimer, the term of this patent is extended or adjusted under 35 U.S.C. 154(b) by 816 days.

(21) Appl. No.: 13/424,675

(22) Filed: Mar. 20, 2012

(65) Prior Publication Data

US 2012/0242040 A1 Sep. 27, 2012

Related U.S. Application Data

(60) Provisional application No. 61/454,736, filed on Mar. 21, 2011.

(51) Int. Cl.

| | |
|---|---|
| ***A63F 3/00*** | (2006.01) |
| ***A63F 9/00*** | (2006.01) |
| *A63F 9/24* | (2006.01) |

(52) U.S. Cl.

CPC ..... *A63F 9/0098* (2013.01); *A63F 2009/2485* (2013.01)

(58) Field of Classification Search

CPC ..... A63F 3/00
USPC ..... 273/272, 292
See application file for complete search history.

(56) References Cited

U.S. PATENT DOCUMENTS

| | | | | |
|---|---|---|---|---|
| 6,682,074 | B2 * | 1/2004 | Weston | 273/459 |
| 2008/0054566 | A1 * | 3/2008 | Schmidt | 273/292 |

* cited by examiner

*Primary Examiner* — Michael Dennis
(74) *Attorney, Agent, or Firm* — Brinks Gilson & Lione

(57) ABSTRACT

A game set which includes a plurality of cards upon which at least one of words and images are displayed in an other than normally recognizable format, a mirror by which a reflection of the words and/or images on the plurality of cards can be viewed in their corresponding normal recognizable format, and a timer for measuring the time it takes a player of the game to correctly recognize the words and/or images displayed on the plurality of cards without the use of the mirror.

8 Claims, 6 Drawing Sheets

GAME SET AND GAME

RELATED APPLICATION

This application is based on U.S. Provisional Application Ser. No. 61/454,736, filed Mar. 21, 2011 to which priority is claimed under 35 U.S.C. §120 and of which the entire specification is expressly incorporated herein by reference.

BACKGROUND

The present invention relates generally to a word or image recognition game. More particularly the present invention relates to a word or image recognition game and a set of game pieces for playing the game.

There are a number of board and table games that people play for entertainment. Such games can challenge a player's skill, strategy, knowledge, memory, logic, etc. as well as add an element of luck or chance. Winner or succeeding at such games thus provides the players with personal satisfaction and a sense of accomplishment.

Board and table games can have varying degrees of challenge or difficulty ranging from easy for novice to extremely difficult for experienced players. In competitive games in which players play against each other the range of difficulty can be directly related to the skill and experience of the players. In other games which challenge a player's memory, knowledge, logic, etc. the range of difficulty can be determined by the individual discrete challenges of such games.

The present invention provides a word or image recognition game and a set of game pieces for playing the game.

BRIEF SUMMARY

According to various features, characteristics and embodiments of the present invention which will become apparent as the description thereof proceeds, the present invention provides a game set that includes:

a plurality of cards upon which at least one of words and images are displayed in another than a normally recognizable format;

a mirror by which a reflection of the words and/or images on the plurality of cards can be viewed in their corresponding normal recognizable format; and a optional timer or clock for measuring or monitoring the time it takes a player of the game to recognize the words and/or images displayed on the plurality of cards without the use of the mirror.

The present invention further provides a method of playing a game which comprises the steps of:

a) allowing a player of the game to view an image that comprises at least one of words and non-textural images which image is displayed in another than a format normally recognizable by the player;

b) allowing the player to determine if the player recognizes the image;

c) allowing the player to view a normal display of the image;

d) confirming whether the player recognized the image in step b) by confirmation in step c); and e) awarding the player a point value based upon the result obtained in step d).

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

Figure 1A:
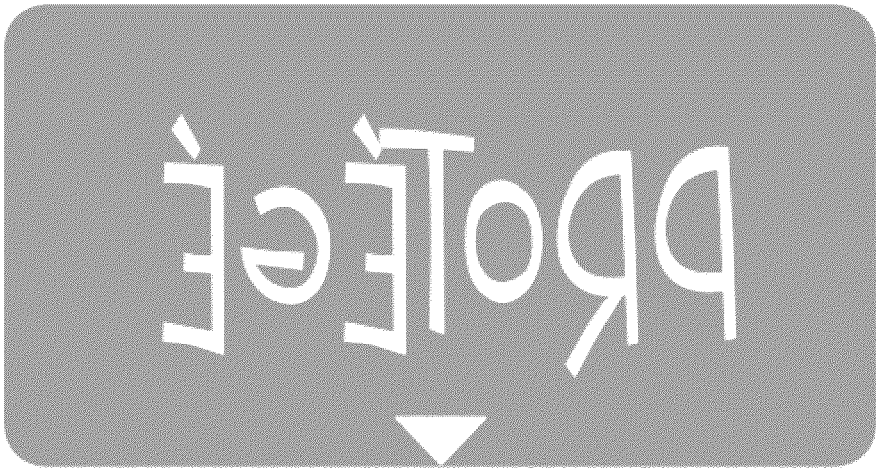
FIG. 1*a* is an example of an initial displayed word according to one embodiment of the present invention.

The present invention is directed to a board game in which a player's progress is determined by his or her ability to visually recognize words and/or images which are initially displayed in a format other that a normal format. For purposes of the present invention in the case of printed words "normal" format refers to words as they are normally written or displayed with their series of letters arranged in properly spelled order from left to right and each individual letter being written or displayed in proper Roman alphabet style. As can be readily understood by those skilled in the art this definition of "normal" format can be applied to languages other than English and alphabets other than the Roman alphabet. Thus the game of the present invention can be adapted to virtually all languages and alphabets. As applied to non-textual images, "normal" refers to non-reversed, non-distorted, non-skewed or non-misaligned images.

Reference herein to "display" as in the initially displayed text according to one embodiment of the present invention refers to the printed display of words and/or images. In other embodiments of the present invention "display" can refer to the electronic display of the words or images as discussed in more detail below.

According to the present invention the game set includes a device that players can use to view initially displayed words and/or images in their normal format in which the words and/or images can be readily recognized by the players. In the initially displayed format (which is other than the normal format) the word and/or images are designed to be difficult for a player to recognize. The relative ease or difficulty of recognizing the initially displayed words and/or images can be based upon the shape and/or size of the individual letters and/or the number of letters in a word or the complexity and/or shape of an image.

According to one embodiment of the present invention the device that a player can use to view initially displayed words and/or images in their normal format comprises a mirror. In further embodiments of the present invention the device that a player can use to view initially displayed words and/or images in their normal format can be an electronic display that is coupled to circuitry that can convert the initially displayed image into the normal image or select between stored "normal" and initially displayed images.

According to one embodiment of the present invention in which the initially displayed words and/or images are displayed in a printed format, the game set of the present invention includes a plurality of cards that have different words and or images printed on at least one side of the cards (in the initial display format). The cards can be of any convenient size, for example 2 inches by 3 inches or larger or smaller.

In the case of providing a mirror to view initially displayed words and/or images in their normal format the mirror can be frameless or mounted in a simple frame which can be handheld. Alternatively the mirror can be provided in a frame that supports the mirror or a surface such as a table in an orientation, e.g. upright, that allows a player to easily view the reverse image of a word or image printed on any of the cards. In further embodiments the mirror can be provided in a frame which includes a structure which receives and holds one of the cards so that the reverse image of a word or image printed on card can be visually observed by a player.

In a further embodiment of the present invention rather than a conventional mirror, a one-way mirror can be used to allow one player to see the reverse image of a word or image printed on a card while the another player only sees the initially displayed image on the card through the one-way mirror.

Figure 1B:
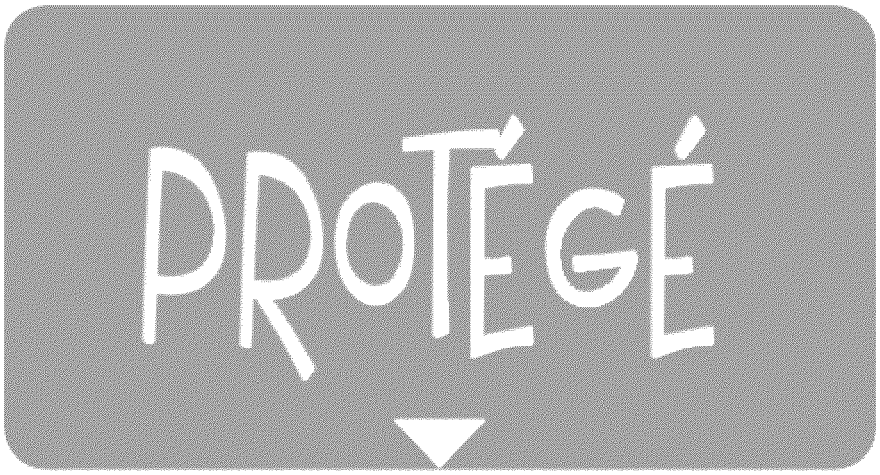
FIG. 1*b* is the reversed image of the initial displayed word of FIG. 1*a*.

FIG. 1*a* is an example of an initial displayed word according to one embodiment of the present invention. FIG. 1*b* is the reversed image of the initial displayed word of FIG. 1*a*.

Figure 2A:
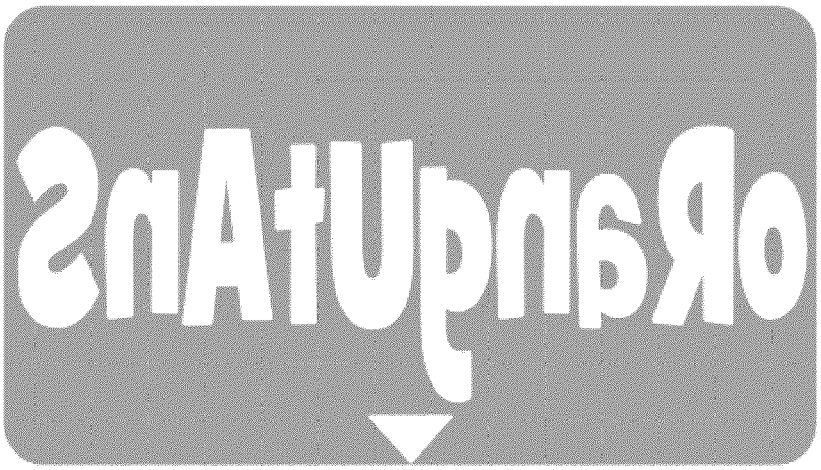
FIG. 2*a* is an example of an initial displayed word according to another embodiment of the present invention.
Figure 2B:
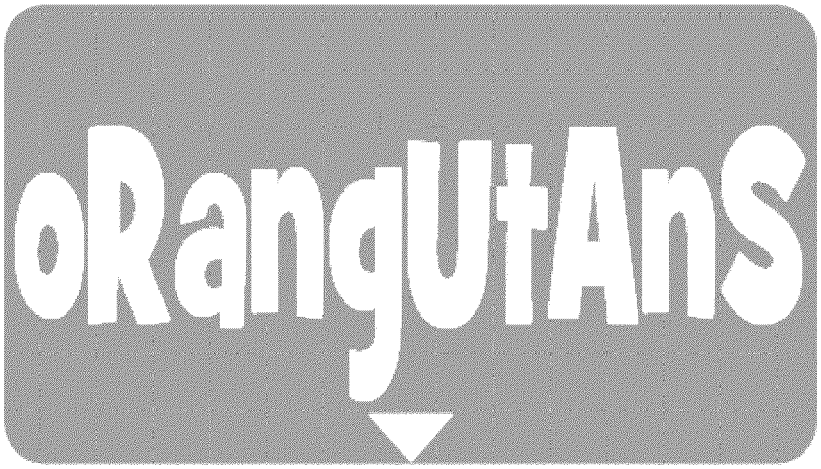
FIG. 2*b* is the reversed image of the initial displayed word of FIG. 2*a*.

FIG. 2*a* is an example of an initial displayed word according to another embodiment of the present invention. FIG. 2*b* is the reversed image of the initial displayed word of FIG. 2*a*.

Figure 3A:
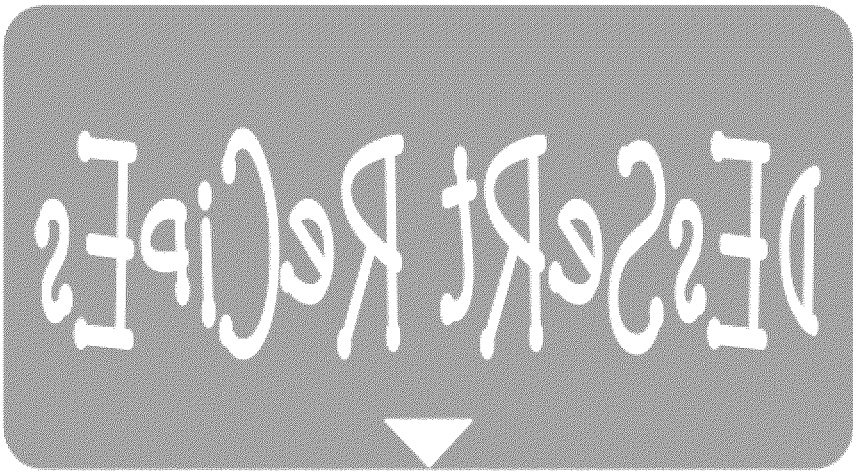
FIG. 3*a* is an example of an initial displayed word according to another embodiment of the present invention.
Figure 3B:
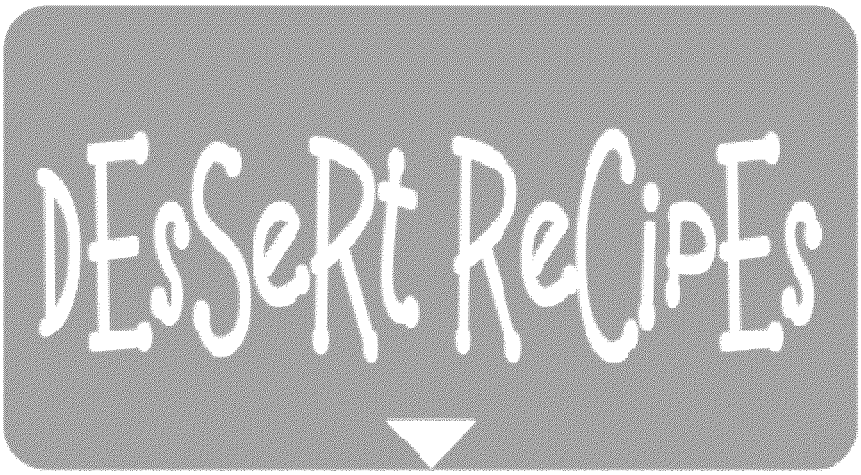
FIG. 3*b* is the reversed image of the initial displayed word of FIG. 3*a*.

FIG. 3*a* is an example of an initial displayed word according to another embodiment of the present invention. FIG. 3*b* is the reversed image of the initial displayed word of FIG. 3*a*.

Figure 4A:
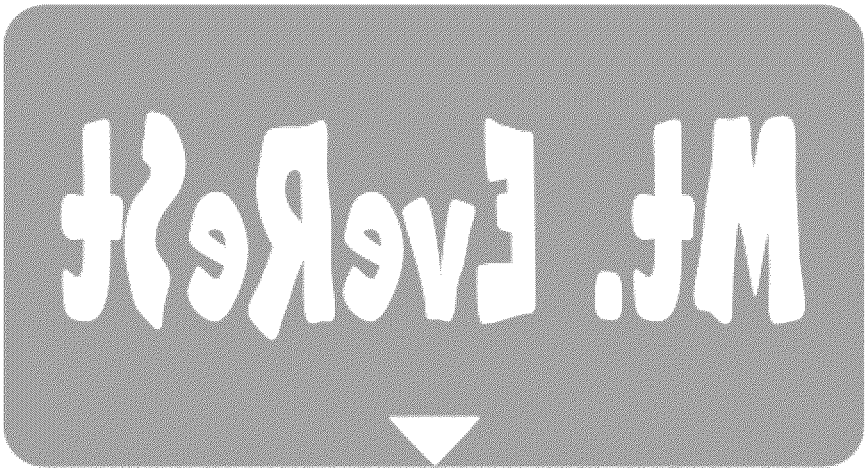
FIG. 4*a* is an example of an initial displayed word according to another embodiment of the present invention.
Figure 4B:
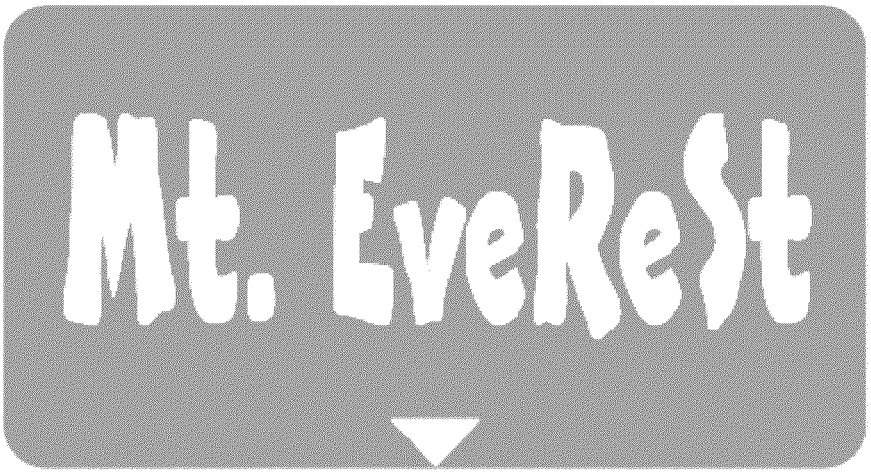
FIG. 4*b* is the reversed image of the initial displayed word of FIG. 5*a*.

FIG. 4*a* is an example of an initial displayed word according to another embodiment of the present invention. FIG. 4*b* is the reversed image of the initial displayed word of FIG. 5*a*.

FIGS. 1*a*-4*b* are examples of the differences between initially displayed words and their reversed images. As can be seen while the initially displayed words (FIGS. 1*a*, 2*a*, 3*a* and 4*a*) are of such a format that can make it difficult to recognize the words, when the images of the initially displayed words are reversed (FIGS. 1*b*, 2*b*, 3*b* and 4*b*) for example by reflection in a mirror it becomes easy to recognize the words.

Figure 5A:
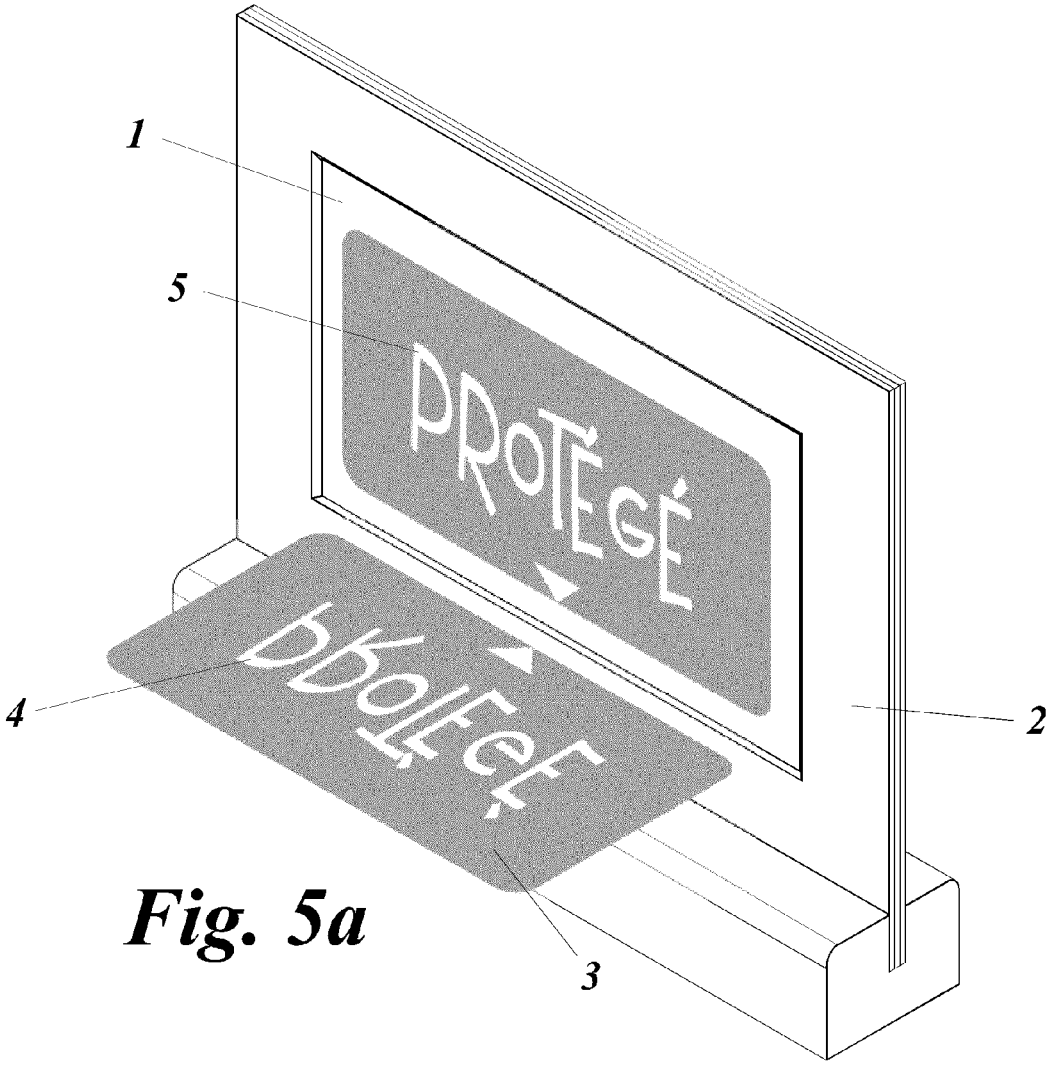
FIG. 5*a* is a perspective view of a mirror according to one embodiment of the present invention illustrating how the image of an initial displayed word is reversed.
Figure 5B:
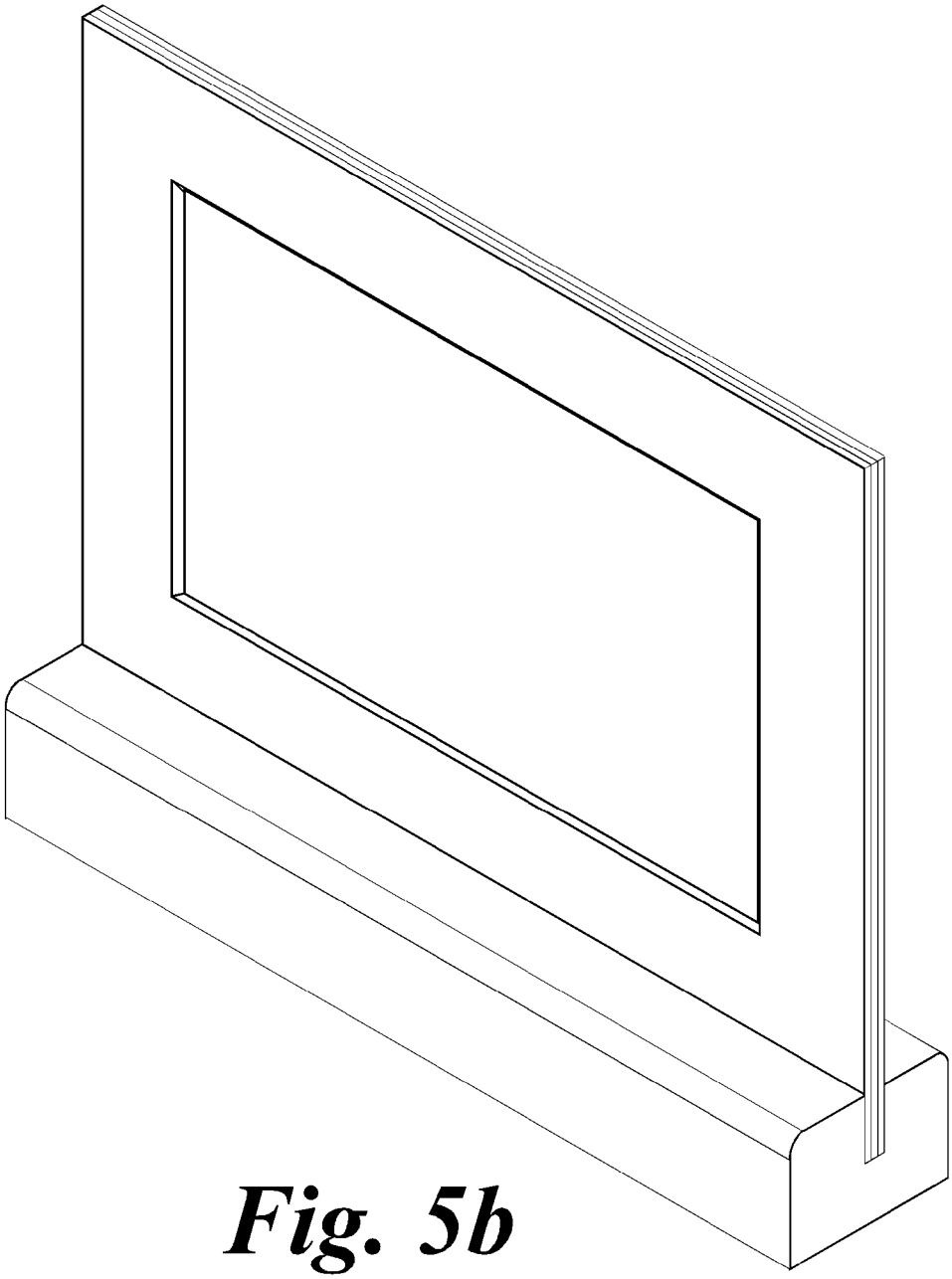
FIG. 5*b* is a perspective view of a mirror of FIG. 5*a*.

FIG. 5 is a perspective view of a mirror according to one embodiment of the present invention illustrating how the image of an initial displayed word is reversed. FIG. 5*b* is a perspective view of a mirror of FIG. 5*a*. In this embodiment the mirror 1 is supported in a frame 2 which allows the mirror to stand upright as shown. In this orientation a card 3 having an initially displayed word or image 4 printed thereon can be positioned in front of the mirror 1 so that a player can observe the reversed or corrected image 5 of the initially displayed word in the mirror 1.

The game of the present invention can be played as follows. A player is given or draws one of a plurality of cards on which the initially displayed words and/or images are printed. Before the player looks at the initially displayed word and/or image on the card he/she or another player starts a timer (or views and monitors time on a clock) that is set to a predetermined period of time, for example 5-30 seconds or more. When the player has determined that he/she knows or recognizes the word and/or image that is displayed on the card, he/she verifies the reversed or corrected image by observing the image in a mirror. Scoring can be accomplished in several manners. For example, if a player correctly recognizes an initially displayed word and/or image within the preset period for which the timer is set he/she is awarded a point value. In an alternative embodiment before a player observes a card having an initially displayer word and/or image printed thereon the player can start a timer and once the player recognizes the correct word and/or image he/she can stop the timer and be awarded a point value which is based upon how quickly he/she recognizes the correct word and/or image. Point values in any case can be zero or deducted for incorrect answers. Herein it is to be understood that the use of a timer or clock are interchangeable for purposes of determining the amount of time it takes for a player to recognize an initially displayed image. It is further noted that the use of a timer/clock is optional in an embodiment of playing the game in which two or more players compete to recognize the same or similar initially displayed images. In such playing embodiment, the player to first correctly identify the initially displayed image would be the "winner" of that round or portion or segment of the game and receive a suitable point value or aware.

Higher point values can be awarded for more difficult words and/or images or younger players can be given easier initially displayed words and/or images while older players can be given more difficult initially displayed words or images.

The basics of the game which involve having players identify or recognize words and/or images and/or phrases which are displayed in the initial formats can be adapted for playing in many different manners as far as how players are given or drawn cards and how point values are awarded.

In another embodiment of the game the initially displayed images and corrected images can be displayed in an electronic hand held device that can be passed from player to player. The device would include a simple display area and either a fixed or removable/interchangeable storage memory containing initial displayed formats and corrected formats of words and/or images (or a circuit to reverse the displayed images) and a simple circuit for selectively displaying the stored initial displayed formats and corrected formats of words and/or images. The hand held device could also include a simple timing circuit to tract the time it takes a player to recognize words and/or images and a circuit to award and track points players receive while playing the game.

In a further embodiment the game described herein could be played on a personal computer with both the initially displayed words and/or images displayed electronically and the corresponding corrected images also displayed electronically once a player believes he/she recognizes the word and/or image. In such an embodiment the game could be played on a stand-alone computer or provided on a central server via which multiple players could gain access and play the game together remotely. It is also within the scope of the present invention to provide the game as a phone application which will allow the game to be played on a mobile phone with both the initially displayed words and/or images displayed electronically and the corresponding corrected images also displayed electronically once a player believes he/she recognizes the word and/or image According to one embodiment of the present invention the game is provided as a game set that is boxed and includes a plurality of cards upon which initially displayed words and/or images are printed, one or more timers, one or more mirrors and optionally scorecards.

While the present invention is described herein with reference to words and/or images that are initially displayed in an initially displayed format that is other that a normal format, it is to be understood that the present invention can use virtually any displayable image, including words, graphic images, phrases, logos, trademarks, English language words and/or phrases, non-English language words and/or phrases, symbols, and other displayable images that people may be familiar with. It is also within the scope of the present invention to skew or distort the alignment or perspective of all or a portion of the initially displayed images, so for example, letters in individual words are not aligned linearly.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. A table game set that consists of elements that are configured to be played on a table which table game set elements include:

a plurality of cards upon each of which at least one of different random words is displayed in another than a normally recognizable format; and a mirror by which a reflection of the words on the plurality of cards can be viewed in their corresponding normal recognizable format.

2. A table game set according to claim 1, further comprising: a timer for measuring the time it takes a player of the game to recognize the words and/or images displayed on the plurality of cards without the use of the mirror.

3. A table game set according to claim 1, wherein the words are printed backwards on the plurality of cards.

4. A table game set according to claim 3, wherein individual letters of the words are printed in difference sizes.

5. A table game set according to claim 3, wherein individual letters of the words are printed in different fonts.

6. A table game set according to claim 3, wherein the individual letters of the words are not uniformly aligned.

7. A table game set according to claim 1, wherein the mirror is provided with a frame that allows the mirror to set upright on a surface.

8. A table game set according to claim 1, further including scoring cards upon which players' scores can be tracked while the game is being played.

* * * * *